United States Patent [19]

Richmond

[11] Patent Number: 4,493,663

[45] Date of Patent: Jan. 15, 1985

[54] ONE-HANDED PADDLE

[76] Inventor: Raymond W. Richmond, P.O. Box 187, Con Can, Tex. 78838

[21] Appl. No.: 456,552

[22] Filed: Jan. 10, 1983

[51] Int. Cl.[3] ..... B63H 16/04

[52] U.S. Cl. ..... 440/101; 441/56; 441/59; 416/63; 416/70 R

[58] Field of Search ..... 441/55, 56, 58, 59, 441/64; 440/101; 135/71; 416/70 R, 63

[56] References Cited

U.S. PATENT DOCUMENTS 2,516,852 8/1950 Burry et al. ..... 135/71
2,811,978 11/1957 Russell ..... 135/71 X
4,233,925 11/1980 Proctor ..... 441/56 X

FOREIGN PATENT DOCUMENTS 528934 11/1921 France ..... 441/56
2492667 4/1982 France ..... 441/58

*Primary Examiner*—Sherman D. Basinger
*Attorney, Agent, or Firm*—Cox & Smith Incorporated

[57] ABSTRACT

A one-handed paddle having a blade portion, a hand-grip portion and an arm brace portion. The arm brace portion has a resilient member which releasably grips the forearm of a user to maintain the arm brace portion in contact with the forearm of the user during use of the paddle.

3 Claims, 6 Drawing Figures

ONE-HANDED PADDLE

BACKGROUND OF THE INVENTION

This invention relates to one-handed paddles and more particularly to a realeasable arm grip for a one-handed paddle.

One-handed paddles are well known in the prior art. Examples of such paddles are shown in the following U.S. Pat. Nos.: 2,188,343—A. F. Flournoy; 3,039,120—L. Powell et al; 3,109,184—H. E. Moore, Jr.; 3,117,325—J. O. Shelton; 3,153,797—R. B. Drennen, Jr.; 3,518,024—P. M. Wilson; 4,233,925—Douglas B. I. Proctor. As shown in the above identified patents, one-handed paddles generally consist of a blade portion which is inserted in the water, a hand grip portion and an arm brace portion so that the paddle can be used with one hand. It is generally desirable that the paddle be of light weight construction and preferably made of material so that it will float and not sink if dropped. In using a one-handed paddle, one tightly grips the hand grip portion and when properly positioned the arm brace will provide the leverage necessary to use the one-handed paddle. The hand grip portion is typically cylindrical so that it can be gripped by the hand. The arm brace portion is typically flat so that it will bear against the forearm in use. Since considerable force may be placed upon the forearm during paddling, it is desirable that the arm brace be comfortable during extended paddling.

It is an object of the present invention to provide a one-handed paddle which includes an arm brace means which grips the user's arm during use and which is readily releasable from the arm when desired. It is also an object of the invention to provide an arm brace member for a one-handed paddle which is comfortable for the user and will not injure the forearm of a user during use. Other objects of the invention will become apparent from the following detailed disclosure.

SUMMARY OF THE INVENTION

The invention comprises a one-handed paddle having a blade portion, a hand grip portion, and an arm brace portion. The arm brace portion includes a resilient member which releasably grips the forearm of a user to maintain the arm brace in contact with the forearm of the user. The arm brace means is designed to easily slip onto the arm of a user and stay in this position while being releasable when necessary. The arm brace means includes a resilient channel having an opening therein so that the forearm may be inserted within the channel and retained in position. The resilient means cushions the arm brace against the arm to provide a comfortable brace.

BRIEF DESCRIPTION OF THE PREFERRED EMBODIMENT

Figure 1:
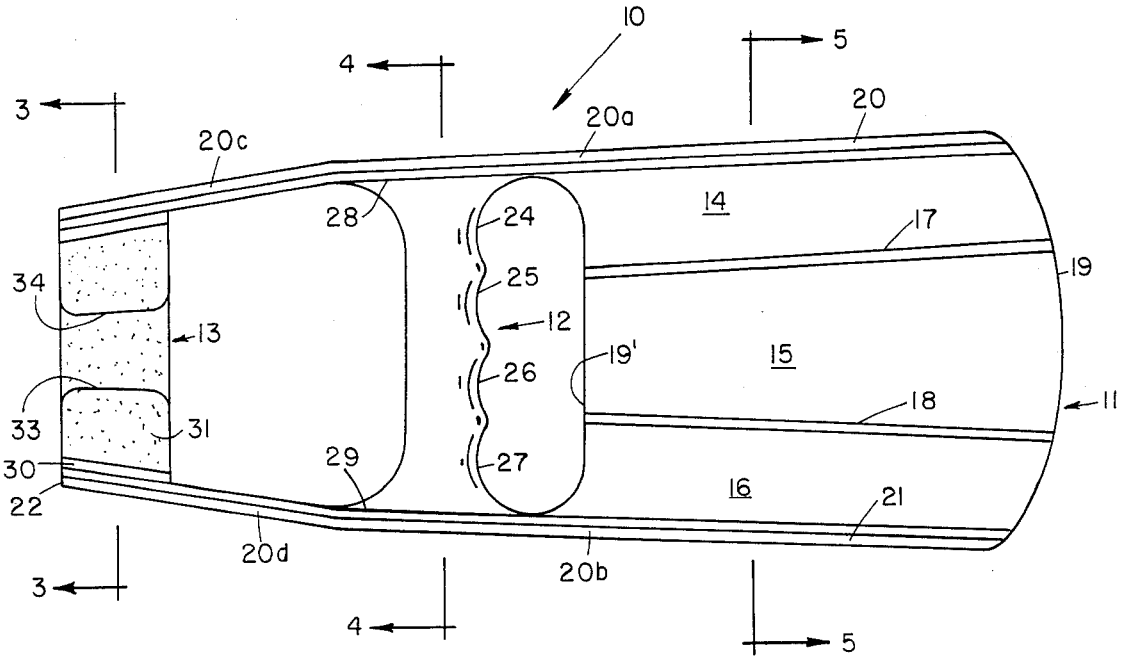
FIG. 1 is a top view showing the paddle of the invention.
Figure 2:
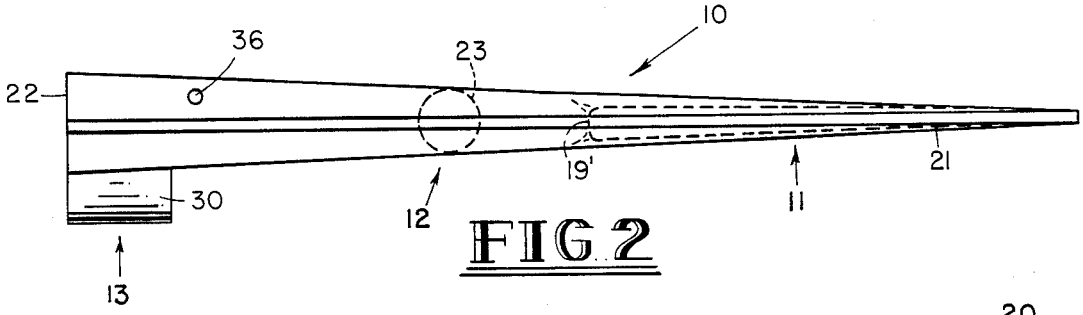
FIG. 2 is a side elevation, showing the paddle of the invention.
Figure 3:
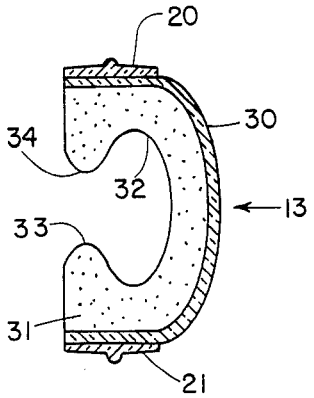
FIG. 3 is a cross-sectional view taken along line 3—3 in FIG. 1.
Figure 4:
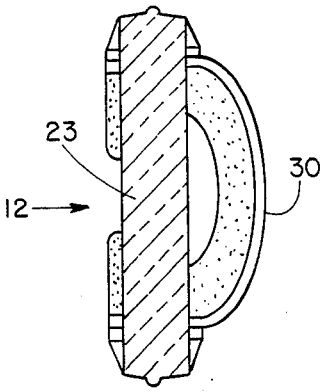
FIG. 4 is a cross-sectional view taken along line 4—4 in FIG. 1.
Figure 5:
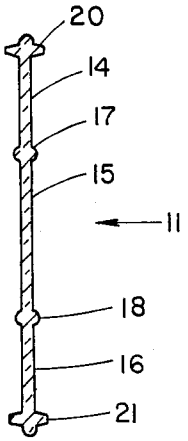
FIG. 5 is a cross-sectional view taken along line 5—5 in FIG. 1.

Referring to FIG. 1 of the drawing, there is shown a paddle 10 embodying the invention. The paddle 10 includes a blade portion 11, a hand grip portion 12, and an arm brace portion 13. The paddle 10 may be of one-piece molded construction which may be of plastic and which floats in water. The blade portion 11 includes three webbed portions 14, 15, and 16 which are separated by reinforcing ribs 17 and 18. The outermost edge 19 of the webbed portions 14, 15 and 16 is curved as best shown in FIG. 1. At the sides of web members 14 and 16 are reinforcing ribs 20 and 21 which are tapered as shown in FIG. 2 and terminate in edge 22. The cross-section of the blade portion is best shown in FIG. 5.

Positioned between the reinforcing ribs 20 and 21 is the hand-grip portion 12 which includes a generally cylindrical member 23 having notches 24, 25, 26 and 27 which forms a hand-grip. The edge 19' of the webbed portions 14, 15 and 16 is spaced from the notches 24, 25, 26 and 27 to allow insertion of a user's hand. The hand-grip portion 12 is secured to the inner surfaces 28 and 29 of the reinforcing ribs 20 and 21. The reinforcing ribs 20 and 21 include first converging sections **20*a* and 20*b* and second converging sections 20*c* and 20*d* which converge at a sharper angle. Secured at the edges 22 is a generally U-shaped member 30 which forms a hand-grip. A resilient foam member 31 is secured to the U-shaped member 30 and includes an arm retaining portion 32 which is generally oval in the shape of a user's arm and includes an opening defined by opening extensions 33 and 34. It is understood that the U-shaped member 30 is secured to the reinforcing ribs 20 and 21 which become wider as shown in FIG. 2 as they extend away from edge 22. The U-shaped member 30 and converging sections 20*c* and 20*d*** may be of one-piece molded construction or may be adhesively secured.

The spacing between the opening extensions 33 and 34 is such that the arm of a user of the paddle can be slipped between these opening extensions because of the resiliency of the foam so that the arm is securely but safely held in position in the arm brace portion 13. The resilient foam member 31 allows insertion of the arm due to the resiliency of the foam. Also, the second converging sections **20*c* and 20*d* as shown in FIG. 1 which converge inwardly are flexible and insertion of the arm in the opening of the arm retaining portion 32 will cause bending or flexing outwardly of the second converging sections 20*c* and 20*d*. A user's arm is securely retained in the arm brace portion by the opening extensions 33 and 34 and the flexibility of the second converging sections 20*c* and 20*d*. However, the arm can easily be removed due to the flexing of the second converging sections 20*c* and 20*d* and the resiliency of the foam member 31** when desired.

Figure 6:
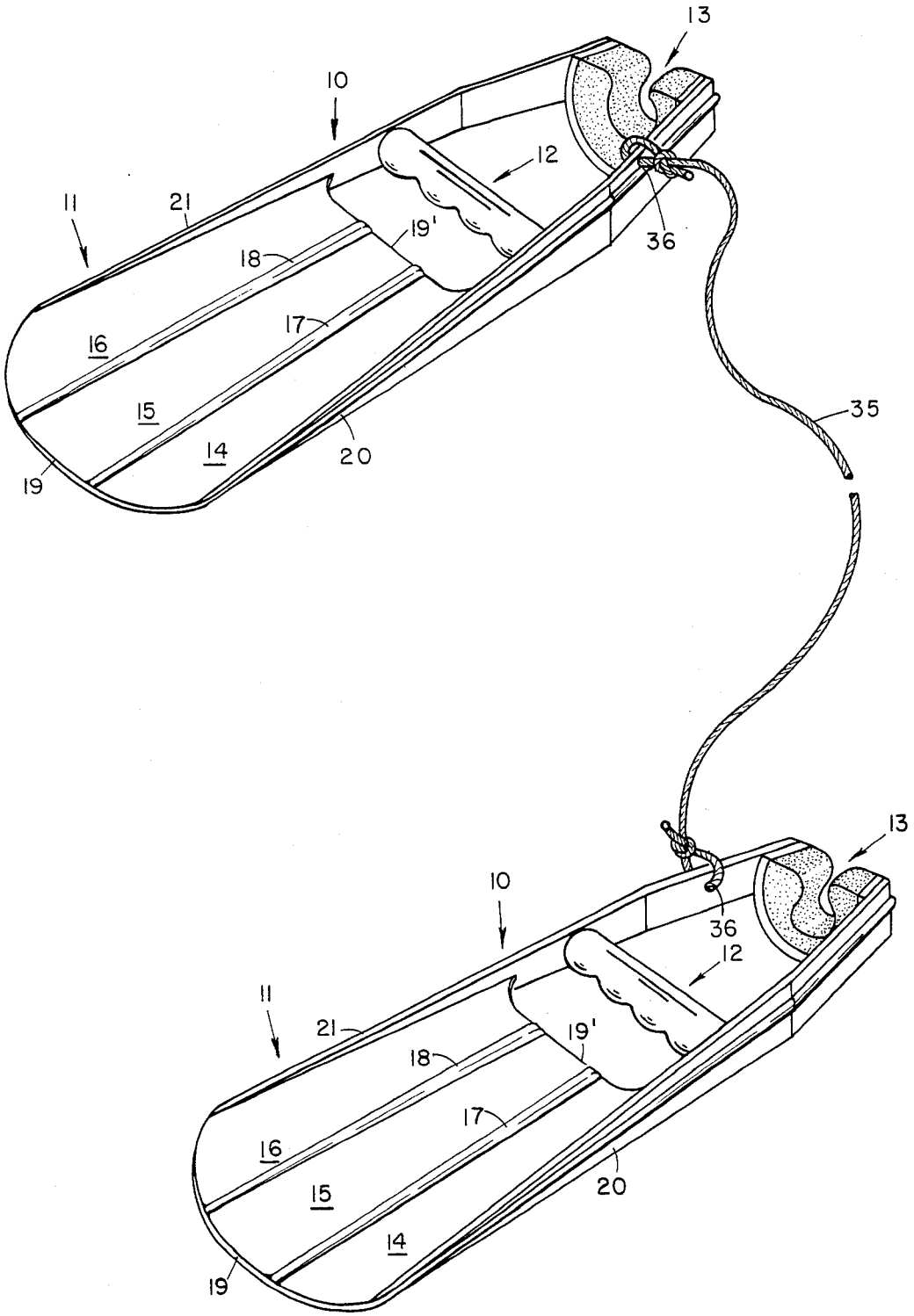
FIG. 6 is a perspective view showing two (2) paddles connected together by a cord.

In order to use the device, generally two paddles will be secured together as shown in FIG. 6 with a cord 35. Cord 35 extends through an opening 36 through one of the second converging sections of the reinforcing ribs. The cord 35 keeps the paddles together so that if one paddle is dropped it will not be lost. The user of the paddle grips the hand-grip portion 12 and forces the lower arm into the arm retaining portion 32 of the arm brace portion 13. The second converging sections **20*c* and 20*d* are flexible enough to allow them to be bent outwardly during this insertion of the arm portion and the resilient foam member 31 also facilitates insertion of the arm in the arm brace portion 13. The arm is comfortably held in the arm retaining portion 32 because of the flexing of the second converging sections and the resiliency of the foam. The arm is comfortably and securely held during use of the paddle, but in case of emergencies can be safely removed should the user desire to drop the paddles. By retaining the arm in the arm retaining portion 32, at times the user can relax his grip on the hand-grip portion 12 and not depend solely upon his grip to maintain the arm brace portion 13** in contact with the arm for paddling.

Although the invention has been described in conjunction with the foregoing specific embodiment, many alternatives, variations and modifications will be apparent to those of ordinary skill in the art. These alternatives, variations and modifications are intended to fall within the spirit and scope of the appended claims.

I claim:

1. A one-handed paddle comprising:

a blade portion, a hand grip portion and a arm brace portion;

said arm brace portion including rearwardly extending flexible arm members at each side thereof which are connected with the hand grip portion and blade portion;

said arm members flexing to allow insertion of a user's arm in the arm brace portion;

the arm brace portion including a generally U-shaped member lined with a resilient member made of a resilient cushioning material which releasably retains and cushions a user's arm in the arm brace portion; and said resilient cushioning material including arm retaining extension members forming an opening for the arm retaining portion smaller than a user's arm for releasably securing a user's arm in the arm brace portion.

2. A one-handed paddle comprising:

a blade portion having reinforcing rib members at each side thereof which converge away from the blade portion;

a hand-grip portion secured between the reinforcing rib members spaced from the blade portion and an arm brace portion secured between the reinforcing rib members spaced from the blade portion and the hand-grip portion;

said reinforcing rib members being flexible to releasably grip and retain a user's arm upon forcing the user's arm into the arm brace portion; and said arm brace portion including a generally u-shaped member lined with a resilient member made of a resilient cushioning material, said resilient cushioning material including arm retaining extension members forming an opening therein smaller than a user's arm which releasably retains and cushions the user's arm in the arm brace portion.

3. The apparatus as set forth in claim 1, wherein:

the resilient member and the rearwardly flexible members cooperate to releasably retain the user's arm in the arm brace portion.

* * * * *